US009406427B2

(12) United States Patent
Kamgaing

(10) Patent No.: US 9,406,427 B2
(45) Date of Patent: Aug. 2, 2016

(54) TRANSFORMER DEVICES

(75) Inventor: Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 1003 days.

(21) Appl. No.: 12/946,577

(22) Filed: Nov. 15, 2010

(65) Prior Publication Data

US 2011/0115597 A1 May 19, 2011

Related U.S. Application Data

(62) Division of application No. 11/842,298, filed on Aug. 21, 2007, now Pat. No. 7,841,070.

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 41/04*** | (2006.01) |
| *H01F 38/14* | (2006.01) |

(52) U.S. Cl.

CPC ..... *H01F 17/0006* (2013.01); *H01F 41/04* (2013.01); *H01F 2027/2819* (2013.01); *H01F 2038/143* (2013.01); *Y10T 29/4902* (2015.01); *Y10T 29/49069* (2015.01); *Y10T 29/49073* (2015.01); *Y10T 29/49075* (2015.01)

(58) Field of Classification Search

CPC ..... H01F 17/0006
USPC ..... 336/200, 223, 232
See application file for complete search history.

(56) References Cited

U.S. PATENT DOCUMENTS

| | | | | |
|---|---|---|---|---|
| 6,927,662 | B2 * | 8/2005 | Kahlmann et al. | 336/200 |
| 7,750,434 | B2 * | 7/2010 | Imaoka et al. | 257/531 |

* cited by examiner

*Primary Examiner* — Mangtin Lian
*Assistant Examiner* — Ronald Hinson

(57) ABSTRACT

A planar transformer or balun device, having small trace spacing and high mutual coupling coefficient, and a method of fabricating the same is disclosed. The method may comprise providing a first and a second inductor on a primary and a second substrate respectively, interleaving at least partially the first inductor with the second inductor, coupling the primary and the secondary substrates to form a unitary structure, and providing electrical contacts to couple the first and second inductors with another device or circuit.

19 Claims, 4 Drawing Sheets

TRANSFORMER DEVICES

RELATED APPLICATIONS

This is a Divisional of

U.S. patent application Ser. No. 11/842,298, which was filed on Aug. 21, 2007, the entire disclosure of which in incorporated herein by reference.

BACKGROUND

1. Technical Field

Embodiments of the invention relate to a planar transformer and/or transmission line balun structure having a small trace spacing and high mutual coupling coefficient and, to a method of fabricating the planar transformer or balun structure.

2. Description of Related Art

Currently, planar transformers are fabricated on single substrate, where both primary and secondary windings or traces of the transformer are monolithically built on the same substrate. To ensure high current-carrying capability and high quality factor, the trace thickness has to be sufficiently large. Large trace thickness, coupled with process limitations, results in large trace spacing and ultimately a large package form factor. For example, in a package substrate, a trace thickness of between 20 μm to 30 μm requires a minimum trace spacing of about 85 μm. On a die substrate, e.g. gallium arsenide or glass, a trace thickness of about 60 μm requires a trace spacing of about 30 μm.

Planar transformers are utilized in wireless communication devices including, but not limited to, transformer-based baluns to convert signals between differential and single-ended modes, for signal filtering in band-pass filters or balanced diplexers, and in differential circuits such as mixers and voltage controlled oscillators. In these various circuits, the transformer can be used, amongst others, for signal balancing, DC isolation or impedance matching. Additionally, in computing systems, transformers may be used in power delivery applications such as coupled buck voltage regulators. In such applications, high quality factor is desired to reduce losses. Also, strong electromagnetic coupling between the primary and the secondary windings of the transformer is desired to provide strong signal transmission therebetween. However, large trace spacing is a severe limitation to increasing electromagnetic coupling and reducing package form factor.

DETAILED DESCRIPTION OF ILLUSTRATIVE EMBODIMENTS

Figure 1:
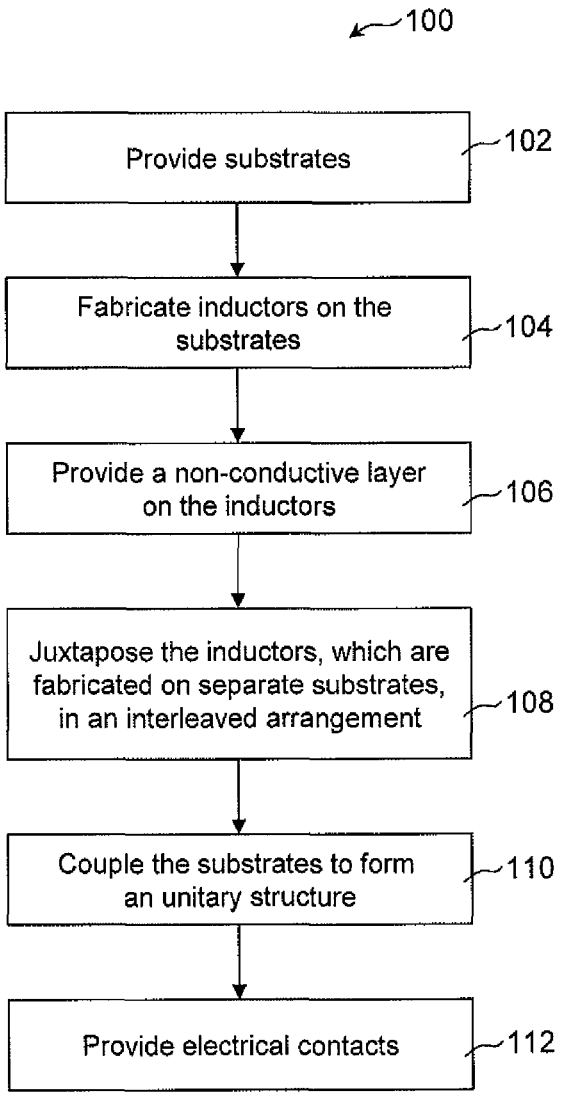
FIG. 1 is a flow chart summarizing a process sequence according to one embodiment of the invention.

In the following description, numerous specific details are set forth in order to provide a thorough understanding of various illustrative embodiments of the present invention. It will be understood, however, to one skilled in the art, that embodiments of the present invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Figure 2A:
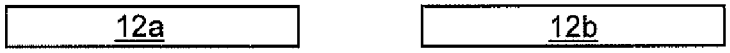
FIGS. 2A to 2F illustrate various process outputs obtained during the process sequence of FIG. 1.

FIG. 1 is a flow chart summarizing a process sequence 100 according to one embodiment of the invention. The process sequence 100 will be described with further reference to FIGS. 2A to 2F illustrating various process outputs obtained during the process sequence 100 of FIG. 1. The process sequence 100 begins with providing substrates 12*a*, 12*b* on which a planar transformer device 10 may be fabricated upon (block 102). Depending on the intended applications, the substrates 12*a*, 12*b*, as illustrated in FIG. 2A, may be a package substrate or a die substrate, e.g. gallium arsenide or glass. The substrates 12*a*, 12*b* may comprise one or more metallization layers having at least an integrated circuit containing active and/or passive components, e.g. capacitors and/or resistors. The metallization layer(s) may be fabricated prior to fabricating the planar transformer device 10.

Figure 2B:
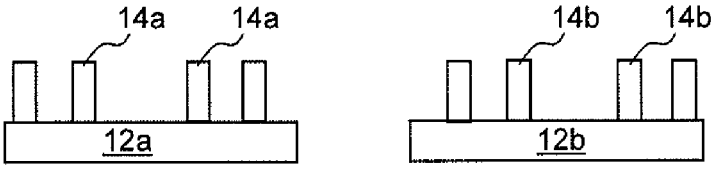

Inductors 14*a*, 14*b* may be fabricated on the substrates 12*a*, 12*b* to form traces corresponding to primary and secondary windings of a transformer (block 104). The inductors 14*a*, 14*b*, as illustrated in FIG. 2B, may be fabricated by first depositing a metal layer on the substrates 12*a*, 12*b*, such as by plating or chemical deposition. Examples of suitable metals include gold, copper, aluminum, silver palladium or any alloys of these metals. This may be followed by appropriate process steps that result in the etching of portions of the deposited metal layer. Unetched portions of the metal layer form a desired trace arrangement e.g. spiral arrangement. Each of the substrates 12*a*, 12*b* (referred to as primary or secondary substrate, in any order) is configured to comprise an inductor corresponding to either the primary side or secondary side of a transformer. Arrangements of the first and second inductors 14*a*, 14*b* (referred to as primary and secondary inductors, in any order) on the substrates 12*a*, 12*b* are complementarily configured such that the first and the second inductors 14*a*, 14*b* form an interleaved arrangement when both substrates are juxtaposed. An example of a complementary arrangement is illustrated in FIG. 2B.

Figure 2C:
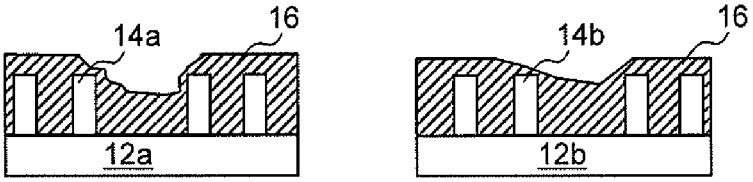
Figure 2D:
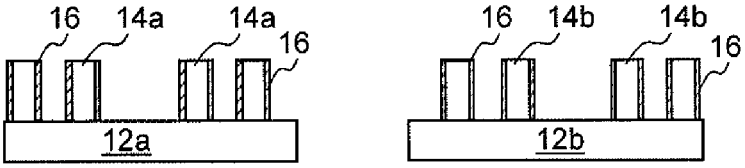

A layer of an electrically non-conductive material 16 may be provided on the first and second inductors 14*a*, 14*b* to provide electrical isolation and protection from environment in a planar transformer device 10 (block 106). One method of providing the electrically non-conductive material 16 involves depositing a layer of the non-conductive material 16 on the substrates 12*a*, 12*b* and surrounding the inductors 14*a*, 14*b* as illustrated in FIG. 2C. Since only a thin layer of the non-conductive material is required, portions of the non-conductive material 16 may be removed, such as by photolithography, to yield the desired thickness. FIG. 2D illustrates a thin layer of non-conductive material 16 is disposed on the first and second inductors 14*a*, 14*b*. The non-conductive material 16 partially overlays each inductor and, particularly, the portions of each inductor that would be juxtaposed against the other inductor in the assembly of the planar transformer device 10. Portions of each inductor that will be coupled to the other substrate may be maintained substantially free of the non-conductive material 16.

The first and second substrates 12*a*, 12*b* of FIG. 2D, together with their corresponding inductors 14*a*, 14*b*, may be juxtaposed to form an interleaved arrangement (block 108).

Figure 2E:
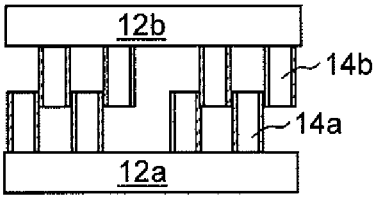

FIG. 2E illustrates one possible method of interleaving the inductors 14*a*, 14*b*. More particularly, the first inductor is at least partially interleaved with portions of the second inductor and, the second inductor is at least partially interleaved with portions of the first inductor.

Figure 2F:
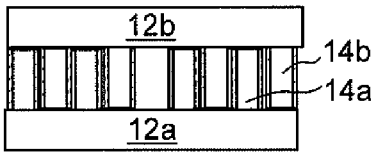

With the juxtaposed arrangement, the first and second substrates 12*a*, 12*b* may be suitably coupled or bonded to form a unitary structure (block 110). To this purpose, the first inductor may be coupled to the second substrate and the second inductor be coupled to the first substrate. Examples of suitable coupling methods include, but are not limited to, direct bonding and adhesive bonding. A resulting unitary structure, as illustrated in FIG. 2F, may be further processed to provide electrical contacts 16 to the inductors 14*a*, 14*b* (block 112). The electrical contacts 16 are to form separate electrical paths to the inductors 14*a*, 14*b* and to provide an electrical interface to another circuit or device.

In certain embodiments where multiple inductors are fabricated on each substrate and therefore multiple transformer devices may be yielded in a unitary structure, singulation may be required to separate such a structure into individual devices.

Figure 3:
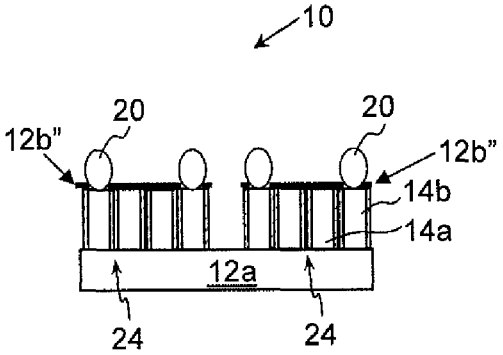
FIG. 3 illustrates a transformer device having electrical contacts directly coupled to inductors of the device.
Figure 4:
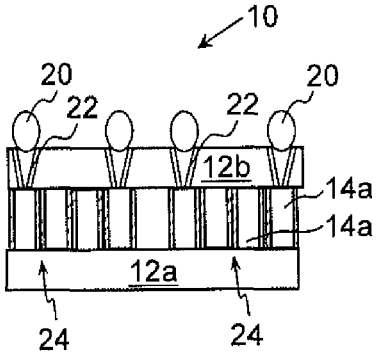
FIG. 4 illustrates a transformer device having electrical contacts coupled to inductors through vias.

FIGS. 3 and 4 illustrate examples of planar transformer devices having different electrical contact configurations. The planar transformer device of FIG. 3 may be fabricated from the structure of FIG. 2F by removing a portion of the first or the second substrate, such as by back grinding, until a thin residual layer 12*b*" of the substrate material remains on the structure to protect the inductors 14*a*, 14*b* from corrosion and trace shortening during assembly. This residual layer 12*b*" may have a thickness substantially lesser than a thickness of the original substrate 12*a*, 12*b*. For example, the residual layer 12*b*" may have a thickness of about 1 μm or less, while the original substrates 12*a*, 12*b* may have a thickness of about 75 μm or more for gallium arsenide, or about 100 μm or more for package substrate. The residual layer 12*b*" may be perforated such that solder bumps 20 may be disposed at the perforations to form electrical contacts connecting to the inductors 14*a*, 14*b*. An intermediate layer of adhesive or flux may be used to bond the solder bumps 20 to the inductors 14*a*, 14*b*.

The planar transformer device of FIG. 4 from the structure of FIG. 2F may be fabricated by forming vias 22 through the substrates 12*a*, 12*b* by laser drilling, etching or other known methods. This may be followed by providing an electrically conductive material in the vias 22, disposing solder bumps 20 on the vias 22 and, coupling the solder bumps to the inductors 14*a*, 14*b*.

According to embodiments of the invention, a planar transformer device 10 may comprise a first substrate having a first inductor fabricated thereon and a second substrate having a second inductor fabricated thereon. Each of the primary and secondary inductors at least partially interleaves with the other inductor and, arranged such that the first and the second inductors 14*a*, 14*b* are interposed between the first and the second substrates 12*a*, 12*b*. The juxtaposed portions of the first and second inductors 14*a*, 14*b* are separated from one another by a thin layer of the non-conductive layer 16. Optionally, an air gap 24 may further separate the first and second inductors 14*a*, 14*b*. With embodiments of the invention, trace spacing (i.e. edge-to-edge distance between primary and secondary inductors) may be as narrow as about 0.5 micron (μm) to about 2 μm.

Electrical contacts 20 may be provided to the planar transformer device 10 in various ways, such as that illustrated in FIGS. 3 and 4. In the embodiment of FIG. 3, electrical contacts 20, e.g. solder balls, are coupled directly to the inductors 14*a*, 14*b* to form separate electrical paths. In the embodiment of FIG. 4, one of the substrates 12*a*, 12*b* is perforated to provide a plurality of vias 22. The vias 22 may be plated or filled to form electrical paths leading to the inductors 14*a*, 14*b*. A plurality of electrical contacts 20 may be disposed on the perforated substrate and separately connecting to the first and the second inductors 14*a*, 14*b* to form separate electrical paths. In other embodiments, electrical contacts 20 may be located at the ends of the traces or any other location on the trace where tapping is required. Tapping or center tapping may be required for DC biasing or RF referencing when the transformer is used in radio frequency (RF) and wireless communication circuits.

Figure 5:
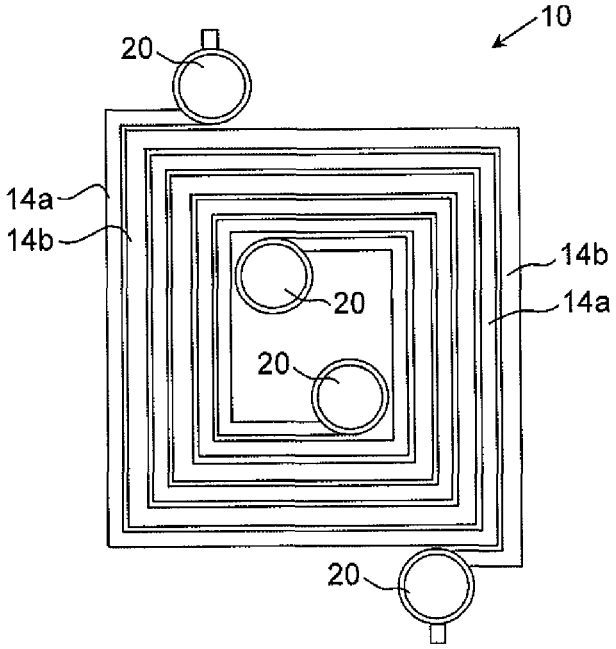
FIG. 5 illustrates a top view of the transformer device of FIG. 3.

Reference is made to FIG. 5 illustrating a top view of the planar transformer device 10 of FIG. 3. As described in the foregoing, portions of the first and second inductors 14*a*, 14*b* are interleaved with each other. Trace spacing between first and second inductors 14*a*, 14*b* are reduced, therefore resulting in a significant increase in mutual coupling coefficient and electrical performance. In addition, smaller trace spacing improves inductance density of the planar transformer device 10, and therefore resulting in a smaller package form factor. To illustrate one embodiment of the invention, a planar transformer 10 may have a trace thickness of about 10 μm to about 15 μm and require a trace spacing of about 1 μm to about 2 μm. In certain embodiments, underpass metal layers may be provided to couple electrical contacts 20 or other circuit elements in the substrates 12*a*, 12*b*.

The planar transformer 10 of FIG. 5 is implemented as two spiral inductors which may behave individually as lumped elements at low frequencies. When the physical length of the spiral inductor is equal to a quarter of the wavelength (corresponding to a given frequency), the planar transformer 10 can be operated at that given frequency as a transmission line transformer, i.e. balun. The planar transformer 10 of FIG. 5 is illustrated as having a square spiral arrangement, but may be implemented as other arrangements, e.g., circular, octagonal, rectangular or serially cascading any of these in the likes of a Marchand balun.

Figure 6:
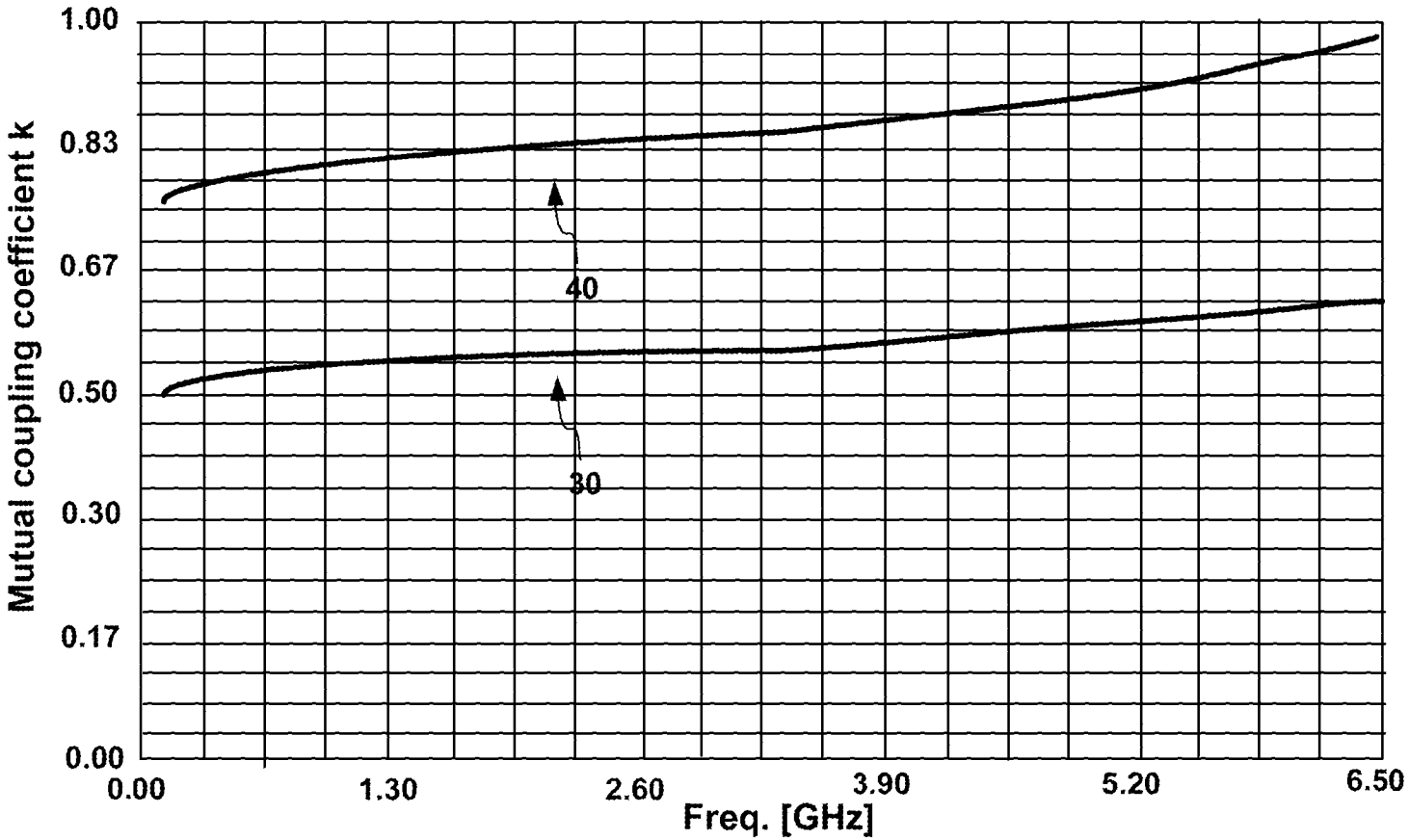
FIG. 6 is a comparison of electromagnetic coupling coefficients of two transformer devices.

FIG. 6 illustrates a full-wave three-dimension modeling analysis comparing the mutual coupling coefficient, k, of a conventional planar transformer device implemented on a single substrate and, a planar transformer device 10 according to one embodiment of the invention. At various frequencies between 0 GHz to 6.50 GHz, a conventional planar transformer has mutual coupling coefficient (k) values ranging between 0.50 and 0.67 (as represented by line 30). Whereas, a planar transformer device 10 according to one embodiment of the invention shows improved mutual coupling coefficient (k) values ranging from 0.75 upwards and tending towards about 1 at higher frequencies (as represented by line 40). The improved mutual coupling coefficient is largely due to the smaller trace spacing which improves inductance density (or inductance per unit area) and electromagnetic coupling between the primary and the secondary sides of the planar transformer device.

The following sets out the characteristics of the planar transformer devices used in the modeling analysis of FIG. 6. The conventional planar transformer, implemented on a single substrate, has an inductor area of about 780 μm×760 μm with an inductance value of 2.4 nH per inductor. This translates to an inductance density of 8.1 nH/mm$^2$ when both primary and secondary inductors are considered. A planar transformer 10 according to one embodiment of the invention has an inductor area of about 756 μm×684 μm with an inductance value of 4.75 nH per inductor. This translates to an inductance density of 18.4 nH/mm$^2$ when both primary and secondary inductors are considered. Accordingly, it is to be appreciated that, in the above example, inductance density or inductance per unit area has increased by more than two times.

Embodiments of the invention may be applicable in a variety of applications, including but not limited to, fast switching power delivery modules for CPU and chipset, and in RF Front End Modules and transceiver chips for wireless communication devices.

Other embodiments will be apparent to those skilled in the art from consideration of the specification and practice of the present invention. Furthermore, certain terminology has been used for the purposes of descriptive clarity, and not to limit the invention. The embodiments and features described above should be considered exemplary, with the invention being defined by the appended claims.

What is claimed is:

1. A transformer device comprising:

a first substrate having a first inductor fabricated thereon; and a second substrate having a second inductor fabricated thereon, wherein the first inductor at least partially interleaves with the second inductor, and wherein the first and the second inductors are interposed between the first and the second substrates.

2. The transformer device of claim 1, wherein the second substrate is perforated to form a plurality of vias to separately couple a plurality of electrical contacts to the first and the second inductors.

3. The transformer device of claim 2, wherein the first and the second inductors are separated by an electrically non-conductive material provided on the first and the second inductors.

4. The transformer device of claim 3, wherein a thickness of the second substrate is less than a thickness of the first substrate.

5. The transformer device of claim 4, wherein the first and the second inductors are further separated by an air gap.

6. The transformer device of claim 4, wherein a trace spacing between the first and the second inductors is about 0.5 micron to about 2 microns.

7. The transformer device of claim 4, wherein the first substrate includes an integrated circuit.

8. A transformer device comprising:

a first substrate having a first inductor affixed thereto;

a second substrate having a second inductor affixed thereto, wherein the second substrate includes an integrated circuit, wherein the first inductor at least partially interleaves with the second inductor, and wherein the first and the second inductors are at least partially interposed between the first and the second substrates; and solder bumps disposed at the second substrate to form electrical contacts connecting to the first and second inductors.

9. The transformer device of claim 8, wherein the first substrate is a package substrate.

10. The transformer device of claim 8, wherein the integrated circuit includes active components and one or more metallization layers fabricated thereon.

11. The transformer device of claim 8, wherein the second substrate includes a plurality of electrical contacts coupled to the first and the second inductors.

12. The transformer device of claim 8, wherein the first and the second inductors are separated by an electrically non-conductive material provided on the first and the second inductors.

13. The transformer device of claim 8, wherein a thickness of the second substrate is less than a thickness of the first substrate.

14. The transformer device of claim 8, wherein a thickness of the second substrate is less than a thickness of the first substrate, and wherein the thickness of the second substrate is about 1 μm.

15. The transformer device of claim 8, wherein the first and the second inductors are further separated by an air gap.

16. The transformer device of claim 8, wherein the integrated circuit includes active components and one or more metallization layers fabricated thereon, wherein the first and the second inductors are separated by an electrically non-conductive material provided on the first and the second inductors, wherein a thickness of the second substrate is less than a thickness of the first substrate, and wherein a trace spacing between the first and the second inductors is about 0.5 micron to about 2 microns.

17. The transformer device of claim 16, wherein a thickness of the second substrate is less than a thickness of the first substrate, and wherein the thickness of the second substrate is about 1 μm.

18. The transformer device of claim 16, wherein the first substrate is a package substrate, and wherein a thickness of the second substrate is less than a thickness of the first substrate.

19. The transformer device of claim 8, wherein the first substrate is a package substrate, and wherein a thickness of the second substrate is less than a thickness of the first substrate, and wherein the thickness of the second substrate is about 1 μm.

* * * * *